US006658672B2

(12) United States Patent
Hsieh

(10) Patent No.: US 6,658,672 B2
(45) Date of Patent: Dec. 9, 2003

(54) HINGE OF TOILET BOWL SEAT AND TOILET BOWL COVER

(76) Inventor: Elvis Hsieh, No. 31, 24th Road, Taichung Industrial Park, Taichung (TW)

( * ) Notice: Subject to any disclaimer, the term of this patent is extended or adjusted under 35 U.S.C. 154(b) by 0 days.

(21) Appl. No.: 10/138,334

(22) Filed: May 6, 2002

(65) Prior Publication Data

US 2003/0204900 A1 Nov. 6, 2003

(51) Int. Cl.[7] ..... A47K 13/12
(52) U.S. Cl. ..... 4/236; 4/240; 4/234; 16/221
(58) Field of Search ..... 4/236, 240, 239, 4/235, 237, 234; 16/221, 249, 240, 236, DIG. 43, 252–3; D8/323–329

(56) References Cited

U.S. PATENT DOCUMENTS

| | | | | | |
|---|---|---|---|---|---|
| 3,570,021 | A | * | 3/1971 | Watson | 4/240 |
| 4,079,471 | A | * | 3/1978 | Corda | 4/240 |
| 5,918,321 | A | * | 7/1999 | Olle | 4/236 |
| 6,071,034 | A | * | 6/2000 | Cavagna | 403/319 |
| 6,453,478 | B1 | * | 9/2002 | Semmler | 4/236 |
| 2001/0013143 | A1 | * | 8/2001 | Cavagna | 4/240 |

FOREIGN PATENT DOCUMENTS

| | | | | |
|---|---|---|---|---|
| FR | 2598310 A3 | * | 11/1987 | A47K/13/12 |
| FR | 2817136 A1 | * | 5/2002 | A47K/13/12 |
| GB | 2364743 A | * | 2/2002 | A47K/13/12 |

* cited by examiner

*Primary Examiner*—Timothy L. Maust
*Assistant Examiner*—Amanda Flynn
(74) *Attorney, Agent, or Firm*—Rosenberg, Klein & Lee

(57) ABSTRACT

A hinge of toilet bowl seat and toilet bowl cover, including a subplate and a sleeve disposed on the subplate. The subplate is integrally formed with an upright column. A top end of the column is formed with an inner thread section. The sleeve has an axial through hole corresponding to the column, whereby the sleeve can be fitted around the column. The sleeve is fixed on the subplate by a bolt corresponding to the inner thread section of the column. An outer diameter of the head section is larger than an inner diameter of the through hole. The bolt is downward fitted into the sleeve and screwed into the inner thread section of the column. The head section of the bolt is stopped at the top edge of the sleeve to fix the sleeve.

2 Claims, 5 Drawing Sheets

HINGE OF TOILET BOWL SEAT AND TOILET BOWL COVER

BACKGROUND OF THE INVENTION

The present invention is related to a hinge of toilet bowl seat and toilet bowl cover, including a sleeve fitted around a column of the subplate. It is very convenient to install the hinge and the hinge is not easy to loosen.

FIGS. 4 and 5 show a conventional hinge of toilet bowl cover. The hinge includes a circular subplate 71 locked on top face of the toilet bowl 72 by a fixing bolt (not shown). An upright column 73 is disposed on the subplate 71. A bolt 74 is upward passed through the subplate from lower side thereof and screwed into the column to fix the column on the subplate 71. A pivot shaft 75 is transversely passed through the top section of the column 73. Two hinge plates 76 are respectively pivoted on two ends of the pivot shaft 75. One of the hinge plates is connected with the toilet bowl cover 77, while the other is connected with the toilet bowl seat 78. By means of the hinge plates 76, the pivot shaft 75 and the column 73, the toilet bowl seat and the toilet bowl cover can be pivoted up or down.

The bolt 74 is upward passed through the subplate 71 from the bottom face thereof. Therefore, after the subplate 71 is mounted on the toilet bowl 72, the bolt head 741 is hidden on inner side of the subplate 71. When replacing the toilet bowl seat or toilet bowl cover and it is necessary to slightly turn the column 73 to aim the hinge plate 76 at the thread hole 781 of the toilet bowl seat (or toilet bowl cover), a user needs to entirely crouch on the floor to untighten the fixing bolt (not shown) to detach the entire hinge assembly. Thereafter, the bolt 74 can be untightened to adjust the column 73. This is quite inconvenient to the user.

The pivot shaft 75 is transversely passed through the top section of the column 73 so that it is impossible to directly downward pass the bolt 74 through the subplate 71.

FIGS. 6 and 7 show another type of conventional hinge. Two sides of the column 81 are respectively provided with two pivot sections 82. Two sides of an end of each hinge plate 83 are provided with two connecting sections 831 corresponding to the pivot sections 82 for connecting therewith. The bolt 84 is downward passed through the column from the top section thereof and then screwed in a thread hole 851 of the subplate 85.

Such structure overcomes the problem of inconvenience in adjustment and detachment. However, the column 81 is directly locked on the subplate 85 only by one single bolt 84. When pivoting the toilet bowl seat and toilet bowl cover, the column 81 and the bolt 84 also suffer external force and tend to loosen due to shocking force. Once the bolt is loosened, the column and the hinge plates connected therewith will also loosen. As a result, the toilet bowl seat and toilet bowl cover can be hardly reliably connected on the toilet bowl.

Furthermore, the subplate 85 has a limited thickness so that the pitch number of the thread hole 851 of the subplate 85 is limited. Therefore, the bolt 84 is locked on the subplate 85 only by the limited thread 841 at the end of the bolt 84. Therefore, the bolt 84 cannot be firmly tightened. Moreover, the thread 841 is easy to break due to the shock caused by pivoting the toilet bowl seat or toilet bowl cover. As a result, the bolt is easy to loosen.

In addition, the column 81 and the two hinge plates 83 are first assembled and then entirely mounted on the subplate 85. Therefore, the total weight of the column and the hinge plates makes the assembly thereof considerably heavy. As a result, it is harder for a user to aim the column at the thread hole of the subplate and tighten the bolt therein. Especially, such kind of hinge is generally metal-made. When placing the column 81 onto the subplate 85, the bottom of the column tends to slip from the subplate. Accordingly, it is quite difficult for the user to on one hand stably aim the column 81 at the thread hole 851 and on the other hand fit the bolt into the column. Therefore, it is quite inconvenient for the user to complete the assembly.

SUMMARY OF THE INVENTION

It is therefore a primary object of the present invention to provide a hinge of toilet bowl seat and toilet bowl cover. The subplate is integrally formed with an upright column. A sleeve is fitted around the column and then a bolt is screwed into the column to fix the sleeve on the subplate. The subplate is fixed on the toilet bowl by a fixing bolt. In case the bolt is loosened, only the sleeve will be slightly loosened, while the stability of the subplate is not affected. Moreover, the sleeve is fitted around the column and supported thereby so that the sleeve is not easy to detach from the subplate. Accordingly, the hinge is firmly connected with the toilet bowl without easy loosening.

It is a further object of the present invention to provide the above hinge of toilet bowl seat and toilet bowl cover. When assembled, once the through hole of the sleeve is aimed at the top end of the column, the sleeve can be downward fitted onto the column. Therefore, even though the bolt is not yet tightened, the sleeve is substantially stably mounted on the subplate. As a result, it is very convenient to tighten the bolt.

It is still a further object of the present invention to provide the above hinge of toilet bowl seat and toilet bowl cover. After the sleeve is downward fitted around the column of the subplate, the bolt is locked at the top sections of the column and the sleeve and exposed to upper side of the toilet bowl. Therefore, when untightening the bolt to adjust the hinge, a user only needs to bow without crouching on the floor.

The present invention can be best understood through the following description and accompanying drawings wherein:

DETAILED DESCRIPTION OF THE PREFERRED EMBODIMENT

Figure 1:
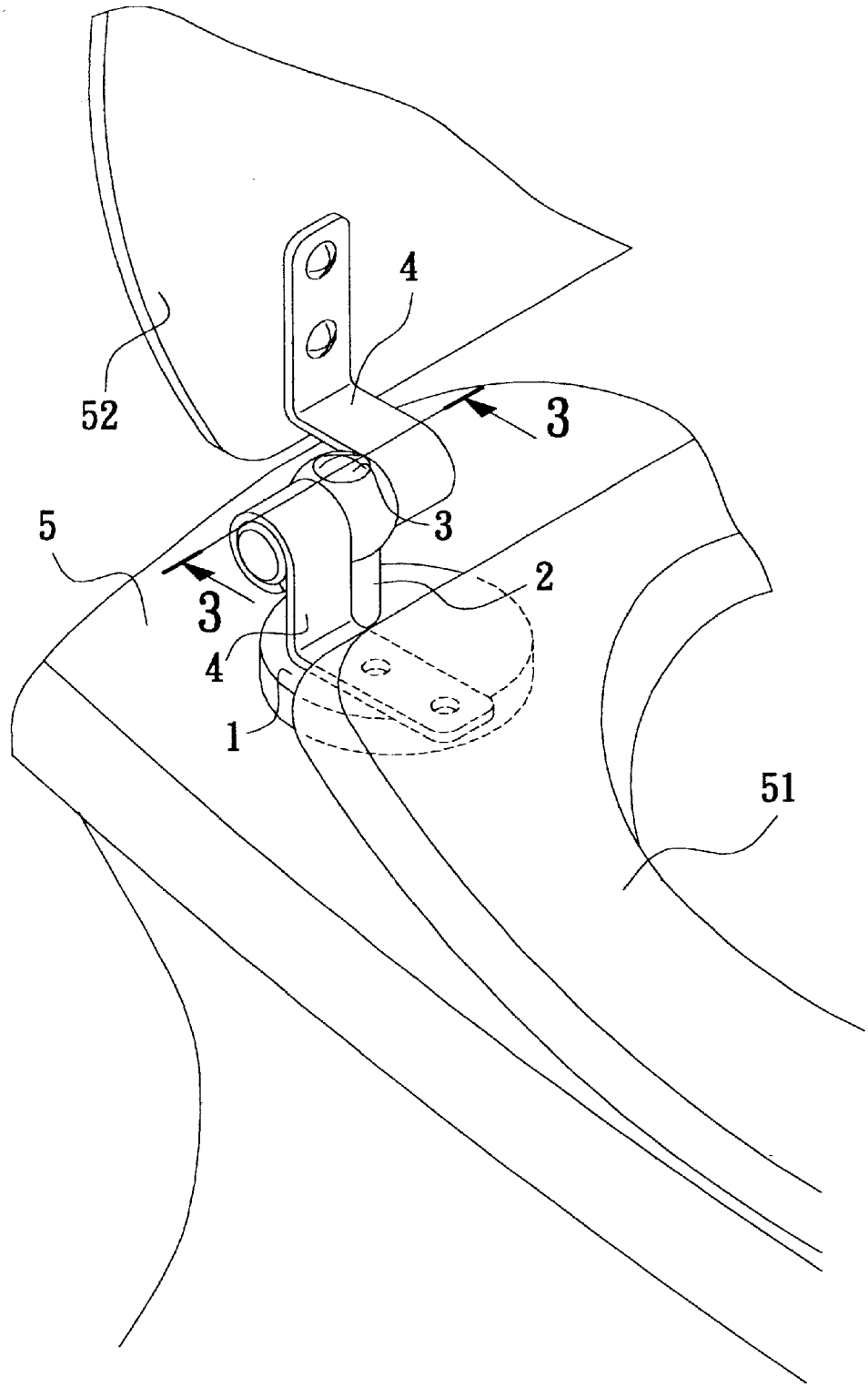
FIG. 1 is a perspective assembled view of the present invention.
Figure 2:
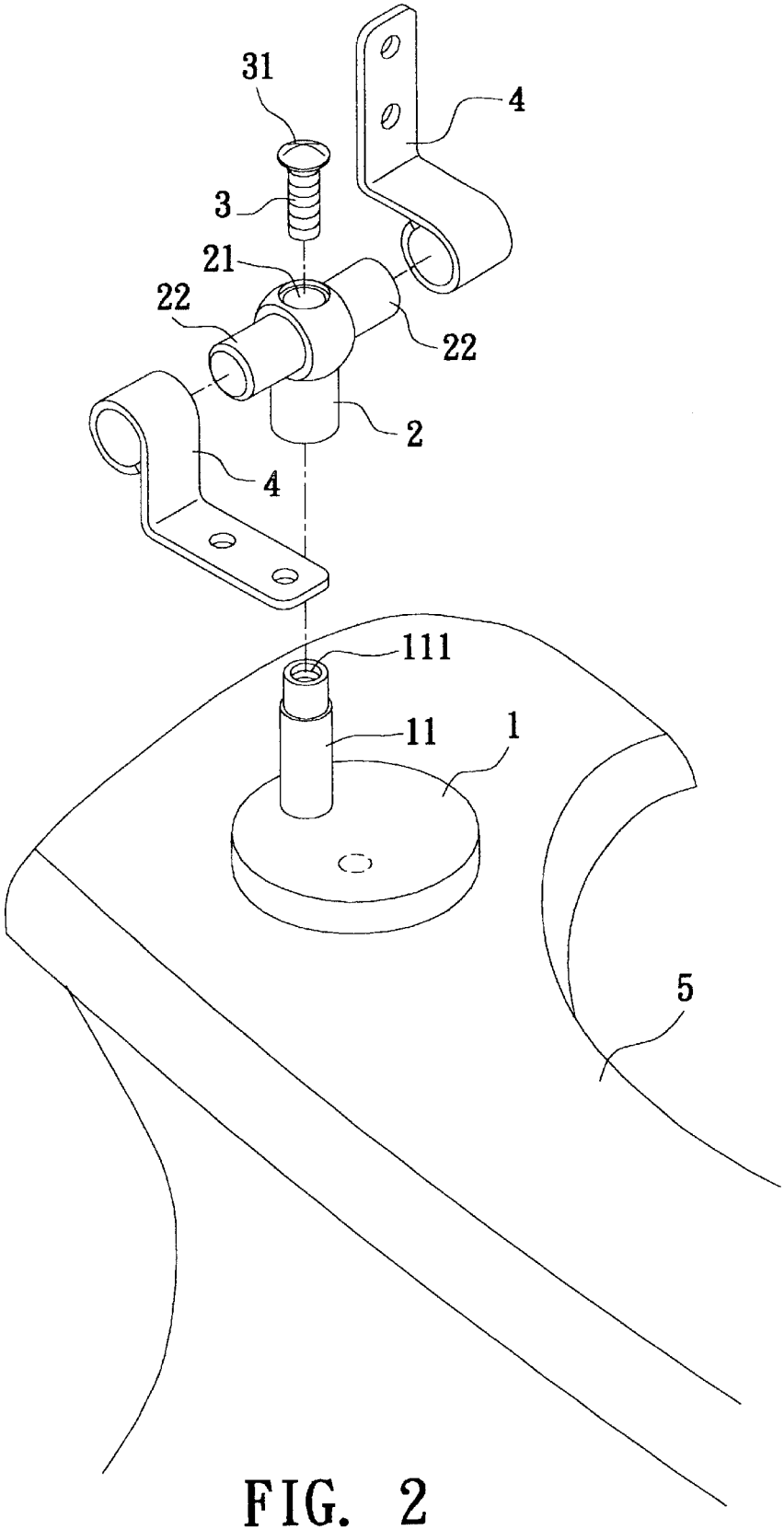
FIG. 2 is a perspective exploded view of the present invention.
Figure 3:
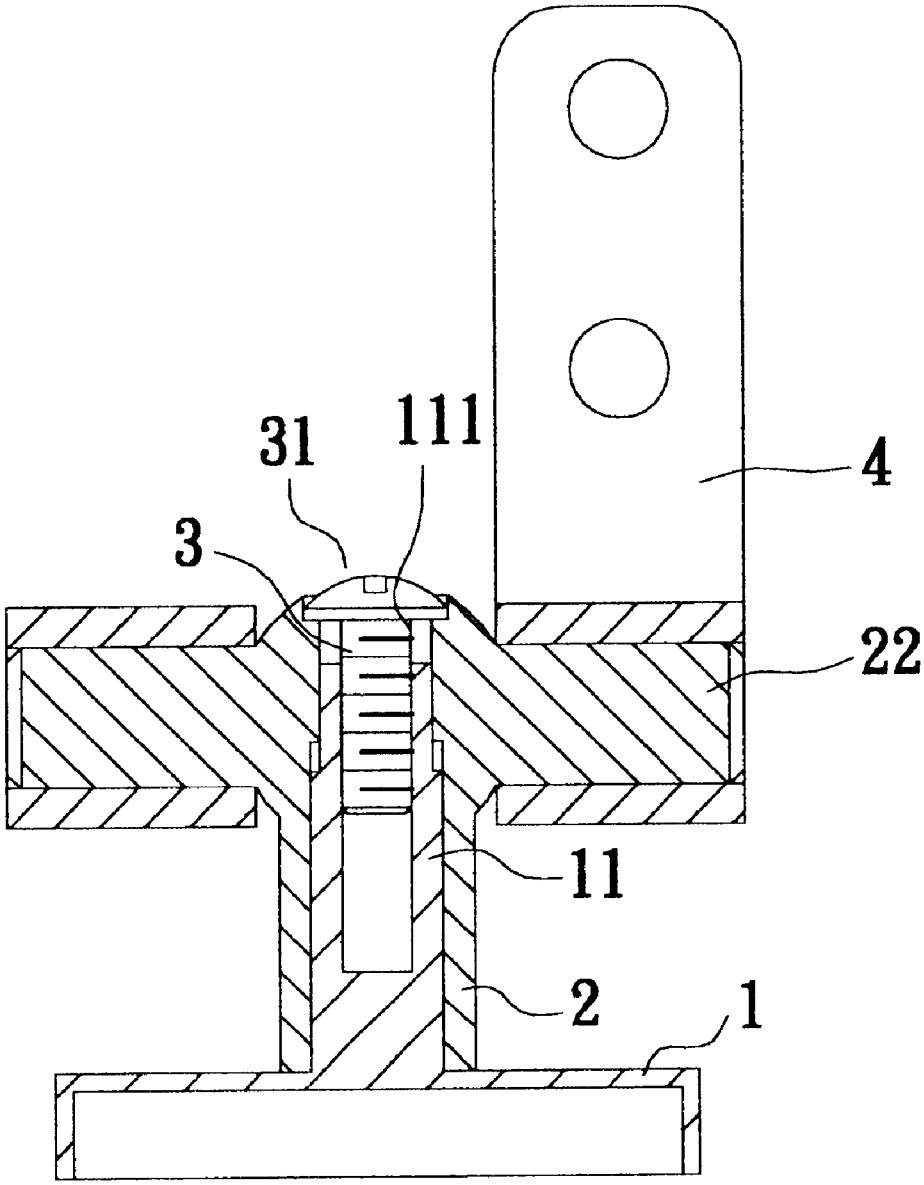
FIG. 3 is a sectional view taken along line 3—3 of FIG. 1.
Figure 4:
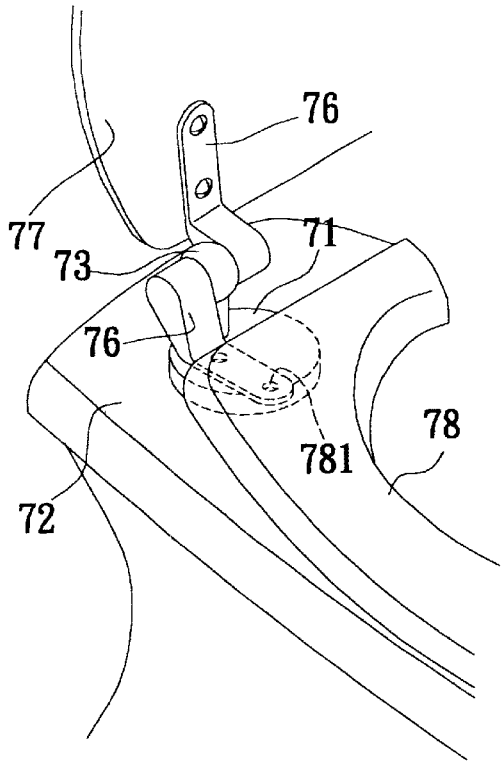
FIG. 4 PRIOR ART
FIG. 4 is a perspective assembled view of a conventional hinge of toilet bowl cover.
Figure 5:
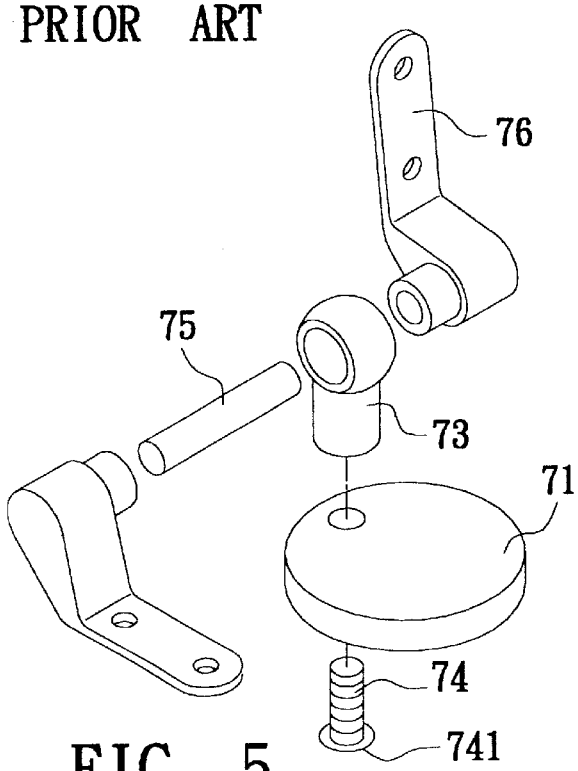
FIG. 5 PRIOR ART
FIG. 5 is a perspective exploded view of the conventional hinge of toilet bowl cover according to FIG. 4.
Figure 6:
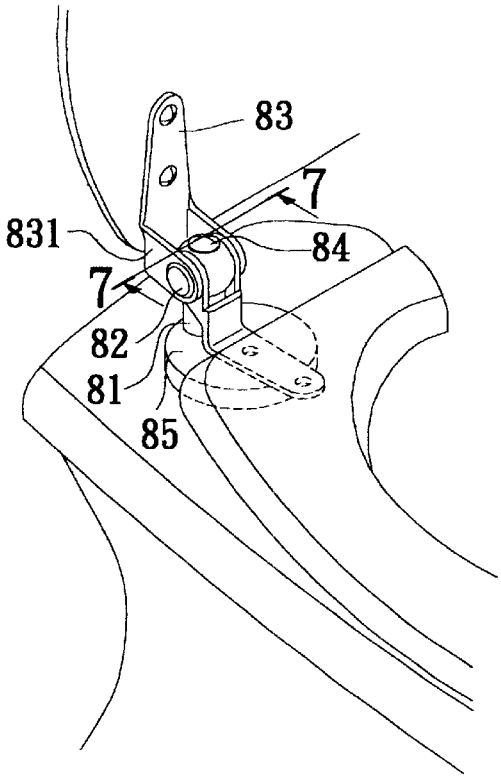
FIG. 6 PRIOR ART
FIG. 6 is a perspective assembled view of another type of conventional hinge of toilet bowl cover.
Figure 7:
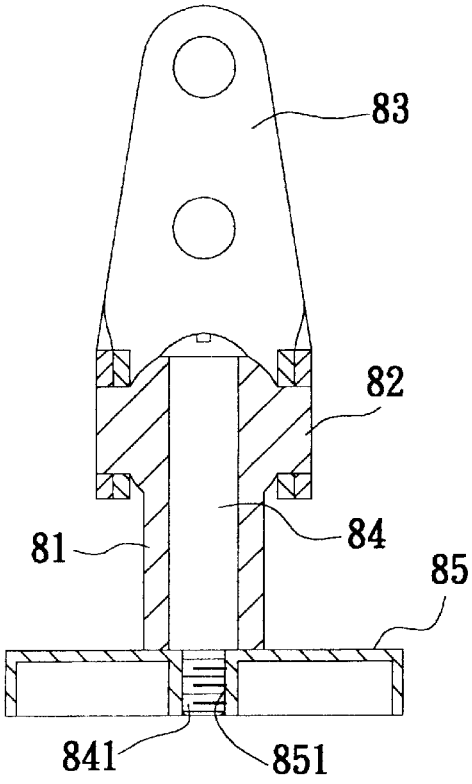
FIG. 7 PRIOR ART
FIG. 7 is a sectional view taken along line 7—7 of FIG. 6.

Please refer to FIGS. 1 to 3. The hinge of toilet bowl seat and toilet bowl cover of the present invention includes a subplate 1 and a sleeve 2.

The subplate 1 is locked on the top face of the toilet bowl 5 by a fixing bolt (not shown). The subplate 1 is integrally formed with an upright column 11. The top end of the column 11 is formed with an inner thread section 111.

The sleeve 2 has an axial through hole 21 corresponding to the column 11. The sleeve 2 can be fitted around the column 11 with the top edge of the through hole 21 higher than the top edge of the column 11. The sleeve is locked on the subplate 1 by a bolt 3. The bolt 3 corresponds to the inner thread section 111 of the column 11 and has a head section 31. The outer diameter of the head section 31 is larger than the inner diameter of the through hole 21. The bolt 3 is downward fitted into the through hole 21 of the sleeve 2 and screwed into the inner thread section 111 of the column 11. The head section 31 of the bolt 3 is stopped at the top edge of the through hole 21 to fix the sleeve 2.

Two pivot shafts 22 respectively integrally project from two opposite sides of the sleeve 2. Two hinge plates 4 each is respectively pivoted on a corresponding one of the two pivot shafts 22. The hinge plates 4 are respectively connected with the toilet bowl seat 51 and the toilet bowl cover 52.

Referring to FIG. 3, the bolt 3 is tightened in the column 11 to fix the sleeve 2. The subplate 1 is fixed on the toilet bowl by a fixing bolt. In case the bolt 3 is loosened, only the sleeve 2 will be slightly loosened, while the stability of the subplate 1 is not affected. Moreover, the sleeve 2 is fitted around the column 11 with the inner circumference of the sleeve 2 snugly attaching to the outer circumference of the column 11. Therefore, the sleeve 2 is not easy to detach from the subplate 1. Accordingly, the toilet bowl seat 51 and the toilet bowl cover 52 can remain well usable.

In addition, when assembled, once the through hole 21 of the sleeve 2 is aimed at the top end of the column 11, the sleeve 2 can be downward fitted onto the column 11. Therefore, even though the bolt 3 is not yet tightened, the sleeve 2 is substantially stably mounted on the subplate 1. As a result, it is very convenient to tighten the bolt 3.

Furthermore, the bolt 3 is locked at the top section of the column 11 and exposed to upper side of the toilet bowl 5. Therefore, when untightening the bolt 3 to adjust the hinge plates, a user only needs to bow without crouching on the floor as in the prior art.

The above embodiment is only used to illustrate the present invention, not intended to limit the scope thereof. Many modifications of the above embodiment can be made without departing from the spirit of the present invention.

What is claimed is:

1. A hinge of toilet bowl seat and toilet bowl cover, comprising a subplate and a sleeve disposed on the subplate, the sleeve being connected with the subplate by a bolt, two hinge plates being respectively pivotally connected with two sides of the sleeve, the hinge plates being respectively connected with the toilet bowl seat and the toilet bowl cover, said hinge being characterized in that:

the subplate is integrally formed with an upright column, a top end of the column being formed with an inner tread section; and the sleeve has an axial through hole corresponding to the column and two pivot shafts respectively integrally projecting from two opposite sides of the sleeve, the two hinge plates each being pivoted on a corresponding one of the two pivot shafts, whereby the sleeve can be fitted around the column, the bolt corresponding to the inner thread section of the column and having a head section, an outer diameter of the head section being larger than an inner diameter of the through hole, the bolt being downward screwed into the inner thread section of the column, the head section of the bolt being stopped at the top edge of the sleeve to fix the sleeve.

2. The hinge of toilet bowl seat and toilet bowl cover as claimed in claim 1, wherein the sleeve is fitted around the column with the top edge of the through hole of the sleeve higher than the top edge of the column.

* * * * *